US005372024A

United States Patent [19]

Rückert

[11] Patent Number: 5,372,024

[45] Date of Patent: Dec. 13, 1994

[54] LOCK-CYLINDER KEY

[75] Inventor: Edvard Rückert, Veibert, Germany

[73] Assignee: Ewald Witte GmbH & Co. KG, Velbert, Germany

[21] Appl. No.: 18,822

[22] Filed: Feb. 18, 1993

[51] Int. Cl.[5] ..... E05B 19/06

[52] U.S. Cl. ..... 70/406; 70/401; 70/409

[58] Field of Search ..... 70/401, 407, 393, 395, 70/402, 405, 406, 409, 387

[56] References Cited

U.S. PATENT DOCUMENTS

| | | | |
|---|---|---|---|
| 586,676 | 7/1897 | Taylor | 70/387 |
| 917,365 | 4/1909 | Schoell | 70/401 |
| 1,616,255 | 2/1927 | Douglas | 70/393 |
| 2,030,837 | 2/1936 | Full et al. | 70/401 |
| 2,035,181 | 3/1936 | Molinare | 70/401 |
| 2,057,532 | 10/1936 | MacDonald | 70/409 |
| 2,301,155 | 11/1942 | Sebestyén et al. | 70/387 |
| 2,395,762 | 2/1946 | Rober | 70/387 |
| 3,669,211 | 6/1972 | Gilgoff | 70/387 |
| 3,754,422 | 8/1973 | Stackhouse | 70/401 |
| 4,296,618 | 10/1981 | Guiraud | 70/401 |
| 4,815,307 | 3/1989 | Widén | 70/392 |
| 4,964,288 | 10/1990 | Braun et al. | 70/406 |
| 5,222,383 | 6/1993 | Fann et al. | 70/409 |

FOREIGN PATENT DOCUMENTS

| | | | |
|---|---|---|---|
| 506198 | 10/1951 | Belgium | 70/406 |
| 318298 | 11/1916 | Germany . | |
| 2204630 | 8/1972 | Germany | 70/492 |
| 2703464 | 8/1978 | Germany | 70/406 |
| 2742165 | 3/1979 | Germany . | |
| 3326024 | 2/1985 | Germany . | |
| 378136 | 8/1932 | United Kingdom | 70/492 |

*Primary Examiner*—Peter M. Cuomo
*Assistant Examiner*—Darnell M. Boucher
*Attorney, Agent, or Firm*—Martin A. Farber

[57] ABSTRACT

The invention relates a lock-cylinder key (S) having bit steps (6) protruding on the wide sides (4) of its key shank (1) for the positioning of the lock-cylinder tumblers (19). In order to obtain a particularly simple but very dependable solution from a locking standpoint, the bit steps (6) represent the extensions of the edges (10) of a wide-side opening (11).

10 Claims, 6 Drawing Sheets

LOCK-CYLINDER KEY

FIELD AND BACKGROUND OF THE INVENTION

The present invention relates to a lock-cylinder key having protruding bits on the wide side of its key shank for the positioning of the lock-cylinder tumblers.

A key with lock cylinder of this type is known from Federal Republic of Germany AS 27 42 165. The basic or cross-sectional profile of the key shank is approximately Z-shaped. Symmetry is present in that the key also fits in the position turned 180°. The bit steps are contacted by plate tumblers.

The bit steps are as a general rule rather narrow so that high precision is important in the interest of an unambiguous contacting function. Upon both machining and shaping of the cross section of the shank the inner transition corners between bit step and the wide surface of the key are concavely rounded, although generally only to a slight extent. Such filletings, however, are at the expense of the width of contact of the bit steps so that in the event of unfavorable tolerance pairings, a certain roughness and even jamming can definitely be noted.

SUMMARY OF THE INVENTION

The object of the present invention is therefore to develop a lock-cylinder key of this type in such a manner, while favorable in manufacture, that such filletings can easily avoided and high precision of contact can be obtained.

A lock-cylinder key of the introductory-mentioned type is provided by the invention which has maximum precision of contact and positioning. The means employed for this are simple; thus, one proceeds in this connection in the manner that the bit steps represent a lengthening of the edges of a wide-side opening. The bit steps continue therefore in the same direction into the cross section of the key shank. The contact or positioning shoulders of the tumblers can no longer come into regions which corrupt their proper positioning, A particularly advantageous prerequisite for the obtaining of said bit-step profile is present when the key shank is of fork shape and the two tine sections of the fork lying on the two sides of the opening in the wide side are arranged displaced offset in opposite direction from the central plane of the wide side. This creates a rather large entrance for the machining and a corresponding reaming path. One advantageous feature furthermore consists therein that the offset is obtained by stamping. Such a stamping can be effected before the production of the bit-step profile or else after it. From the standpoint of stability it is then advantageous for the opening in the wide side to be of window shape. In this way, a physical attachment is present between the fork tines which stabilizes the key shank and can commence already at the end facing away from the handle of the key. All this can be obtained also by several window openings which lie one behind the other. Regardless of whether there are several window-shaped openings or only one of them, the inner silhouette of the key shank created by the opening can be used in any event as further means for variation in the manner that a suitable spring-actuated additional tumbler acts on the lock cylinder. This tumbler can enter perpendicular to the wide side of the flat key or else in the form of an arc, in which case the bit steps and their extensions would be adapted corresponding to the arcuate shape. It is furthermore advantageous for the window shape to be obtained by arms which connect the fork tines and are of smaller thickness than the fork tines. The thickness of the arms preferably decreases further behind the width of the bit steps so that the advantage of reaming with regard to the wide side opening described can be utilized also in this region. A feature which furthermore enriches the variation in profile finally also results from the fact that also the outer narrow edge of the fork tine sections is provided with bit steps. Finally, it is also favorable for the bit steps and the wide-side openings to be cut in one operation by a jet, for instance a fluid jet or laser beam. Not only the speed of cutting which can be obtained thereby but also the devices which correspond to the rapid manner of operation favor the use of such a method here to a particular extent, so that this idea of use is even of independent inventive importance. Furthermore several plates,or in the case of stamping, key blanks can be placed congruently one top of the other for further cutting in the inner region; the manufacture is thereby made more economical. With respect to the fluid cutting medium use is made of water or oil.

BRIEF DESCRIPTION OF THE DRAWINGS

With the above and other and other advantages in view, the present invention will become more clearly understood in connection with the detailed description of three preferred embodiments, when considered with the accompanying drawings, of which.

DETAILED DESCRIPTION OF THE PREFERRED EMBODIMENTS

Figure 1:
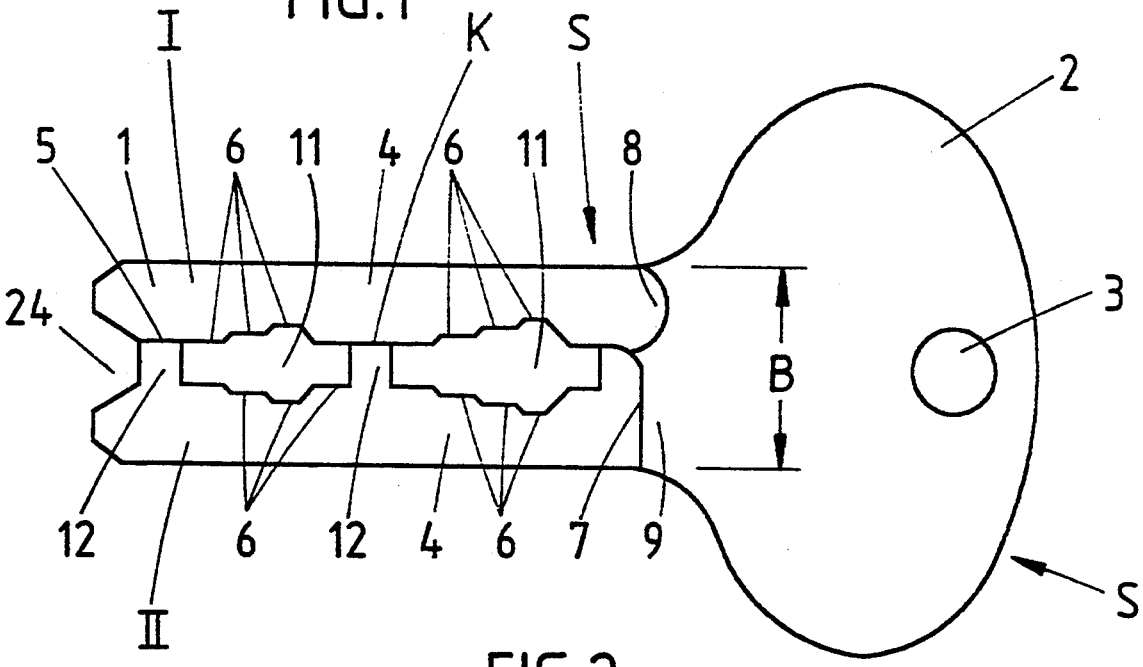
FIG. 1 shows the lock-cylinder key of the invention in the one side view.

The lock-cylinder key S which is shaped in all embodiments as a flat key of 180° symmetry has a key shank 1 and a handle 2 for gripping it. The handle 2 which clearly extends beyond the base width B of the key shank has a transverse hole 3 for placing it on an ordinary key ring, not shown here.

The key is jet-cut. This applies preferably to the entire contour and inner regions. The keys can also, however, be stamped out. At the very start, or else later on, the key is so shaped in the region of its key shank 1 as to produce an approximately Z-shaped basic or cross sectional profile. The corresponding offset or partial offset of the plane of the blank leads in this connection to outwardly shifted parts of material which have their planes offset in steps with respect to the handle 2. These parts of material can be produced perpendicular to longitudinal shoulders aligned with the plane of symmetry or wide-side center plane x—x of the key S, on which shoulders the desired profile of bits steps 6 is developed, comparable to the closure notches which are normally formed on the narrow edges of the key shank. The bit steps 6 therefore do not experience their contacting in, or only in, the region of the narrow edges but also in a plane which is set back with respect thereto on the wide sides 4 of the key 6.

The corresponding set back is so great that it clearly extends beyond the transverse central plane y—y of the key S. The transverse central plane y—y is also, at the same time, the plane of symmetry.

Corresponding to the basic Z-shape, the bit steps 6 are directed offset in their plane with respect to each other, some on the right and the others on the left of the plane x—x.

The bit steps 6 of both longitudinal shoulders 5 are developed on three different depths of step with respect to the longitudinal center axis z—z of the key S which forms at the same time the axis of turn. In the embodiment shown, the depth increases stepwise in the direction of insertion of the key. The size of the steps is the same.

The offset leading to the Z-profile is obtained, as already indicated, by stamping the blank. The offset edge produced in this connection on both sides, i.e. on both wide surfaces 4, bears the reference letter K. It extends over the length of the depth of insertion of the key shank 1 parallel to the said longitudinal center axis z—z of the key and passes at the region of the end near the handle into a bend 7 which is transverse thereto. This bend extends at an angle of 90° to the longitudinal center plane z—z.

Figure 2:
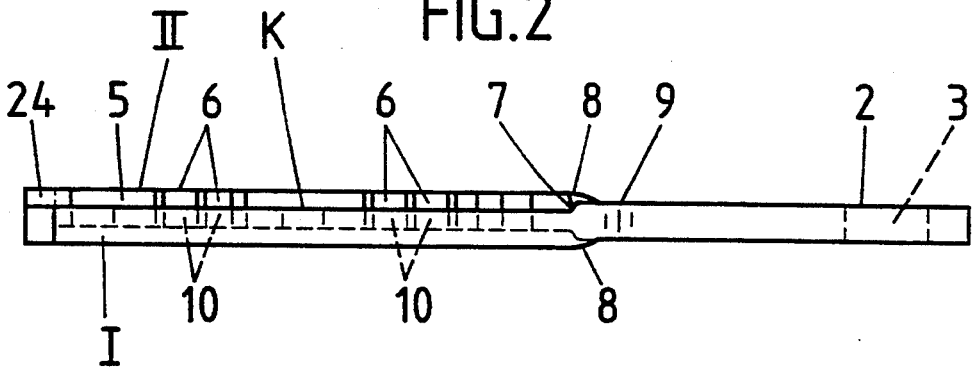
FIG. 2 is a top view thereof.
Figure 3:
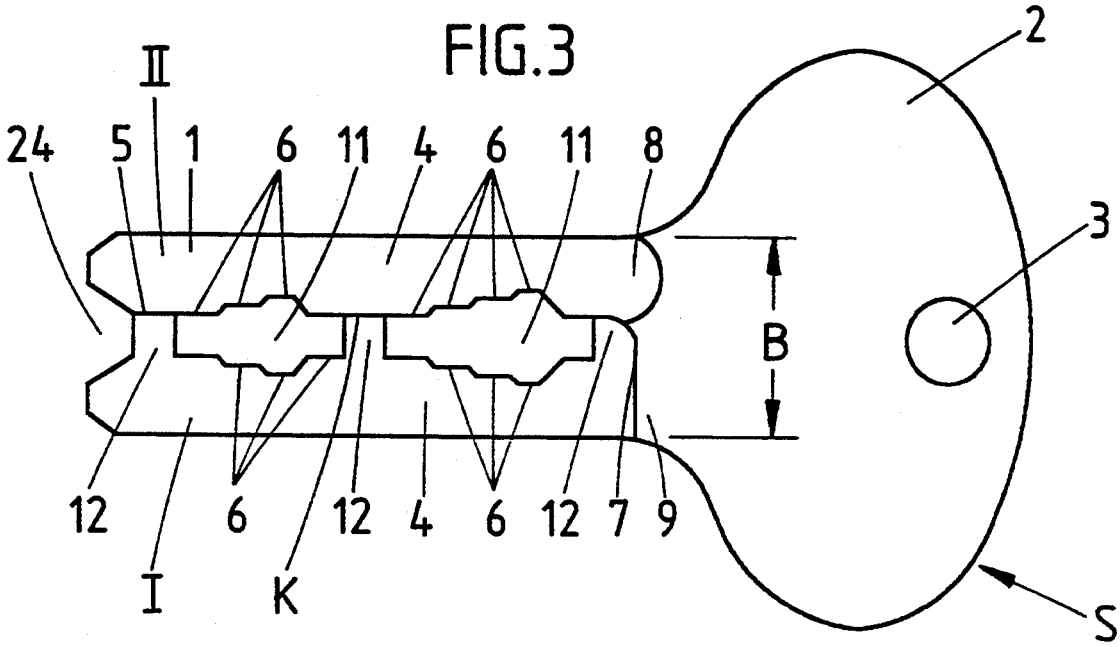
FIG. 3 shows the lock-cylinder key in the other side view, incorporating the first embodiment and shown enlarged.
Figure 4:
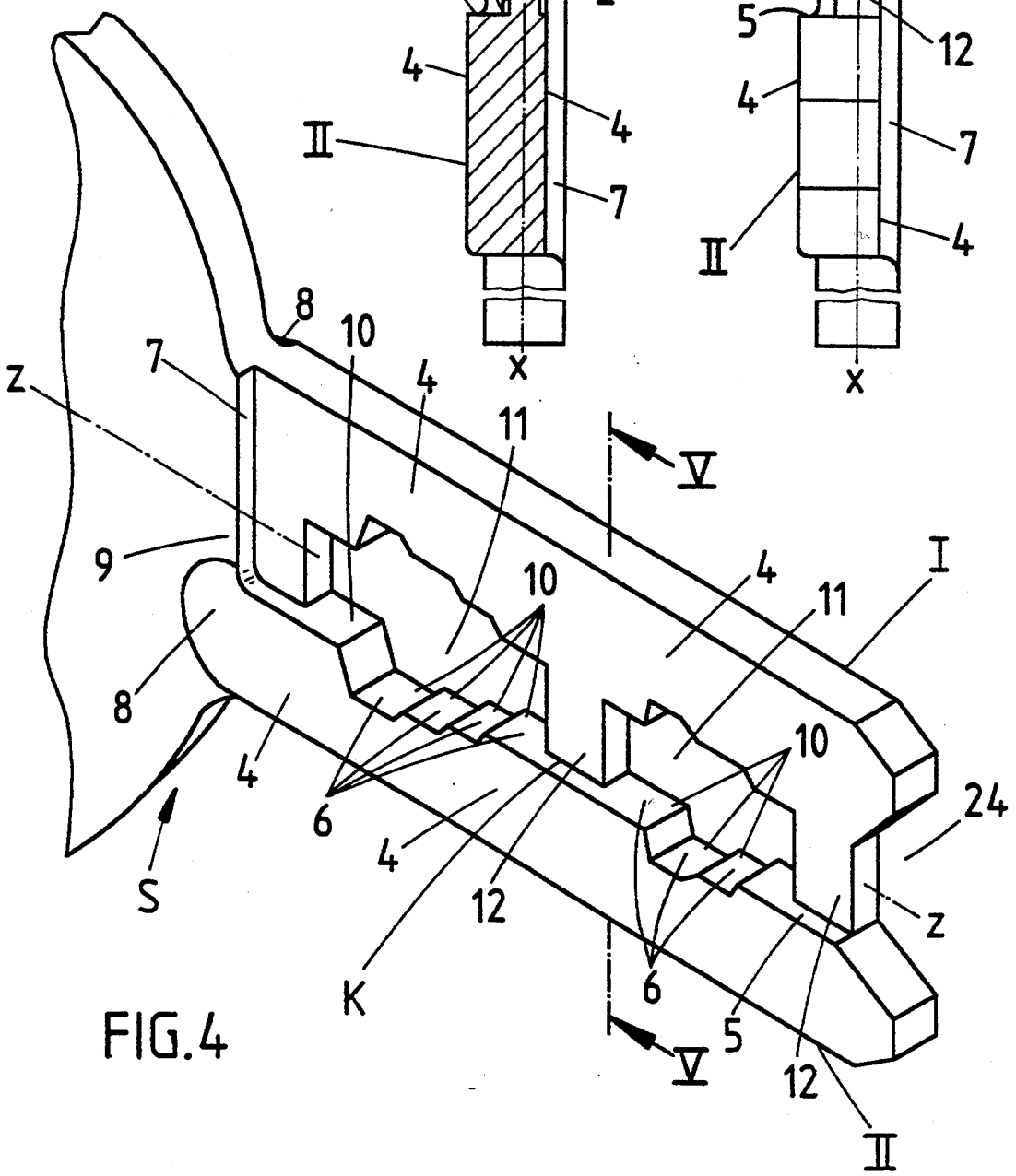
FIG. 4 shows said key in perspective.

The profile-forming offset of the upper portion of the shank with respect to the lower portion of the shank leads to tongue-like terminations or transitions 8 which, in the region 9 of the root of the handle, pass into the wide side of the handle 2 (see FIGS. 2 and 4).

The corresponding polydirectionality in the transition region between the region 9 of the root of the handle and the end of the key shank 1 there produces a stabilizing action.

The offset edge K leading to the Z-profile is aligned with a part of the bit steps 6.

In order to have the bit steps 6 pass with maximum precision, i.e. free of rounding, into the adjoining unexposed sections of the wide sides 4, the development is such that the bit steps represent lengthenings of equal height of the edges 10 of a wide-side opening 11. In other words, the longitudinal shoulders 5 or bit steps 6 continue into the Z-arm or beyond the Z-arm. Upon the development of the shoulder, therefore, one can work transversely therethrough. Filletings of the aforementioned type are thus avoided. The entire width of the bit step is available for precise contacting.

Instead of a reaming which extends somewhat deeper than the plane of offset of the steps 6, an opening which passes through the entire thickness of the key body can be provided, as shown in all three embodiments.

Figure 9:
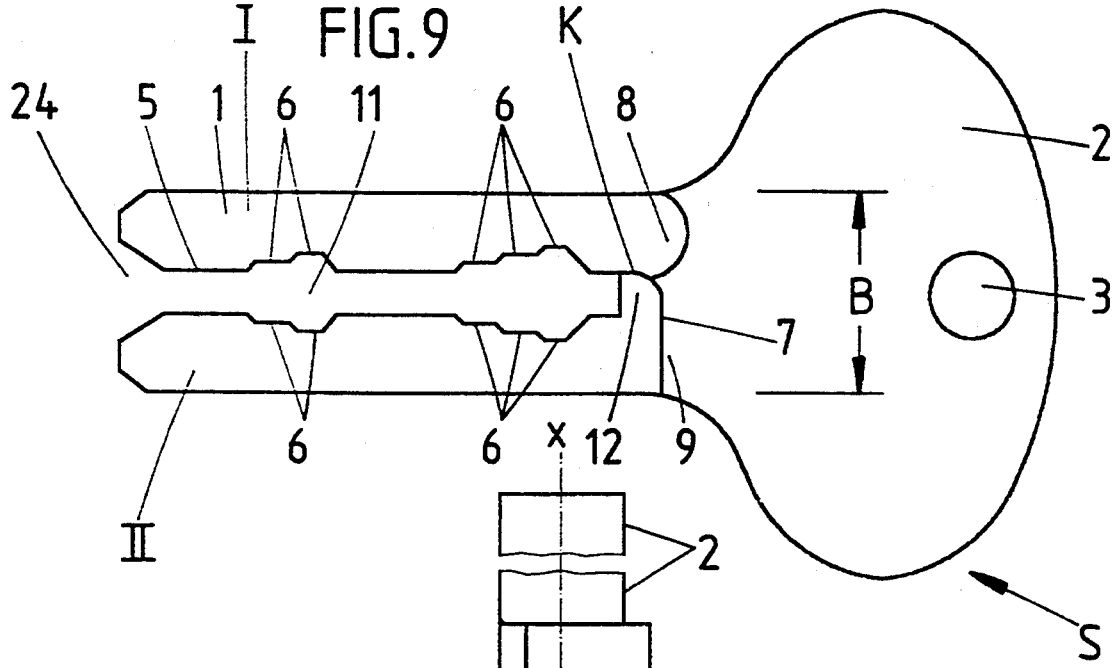
FIG. 9 shows the lock-cylinder key in accordance with the second embodiment, shown in side view, enlarged.
Figure 10:
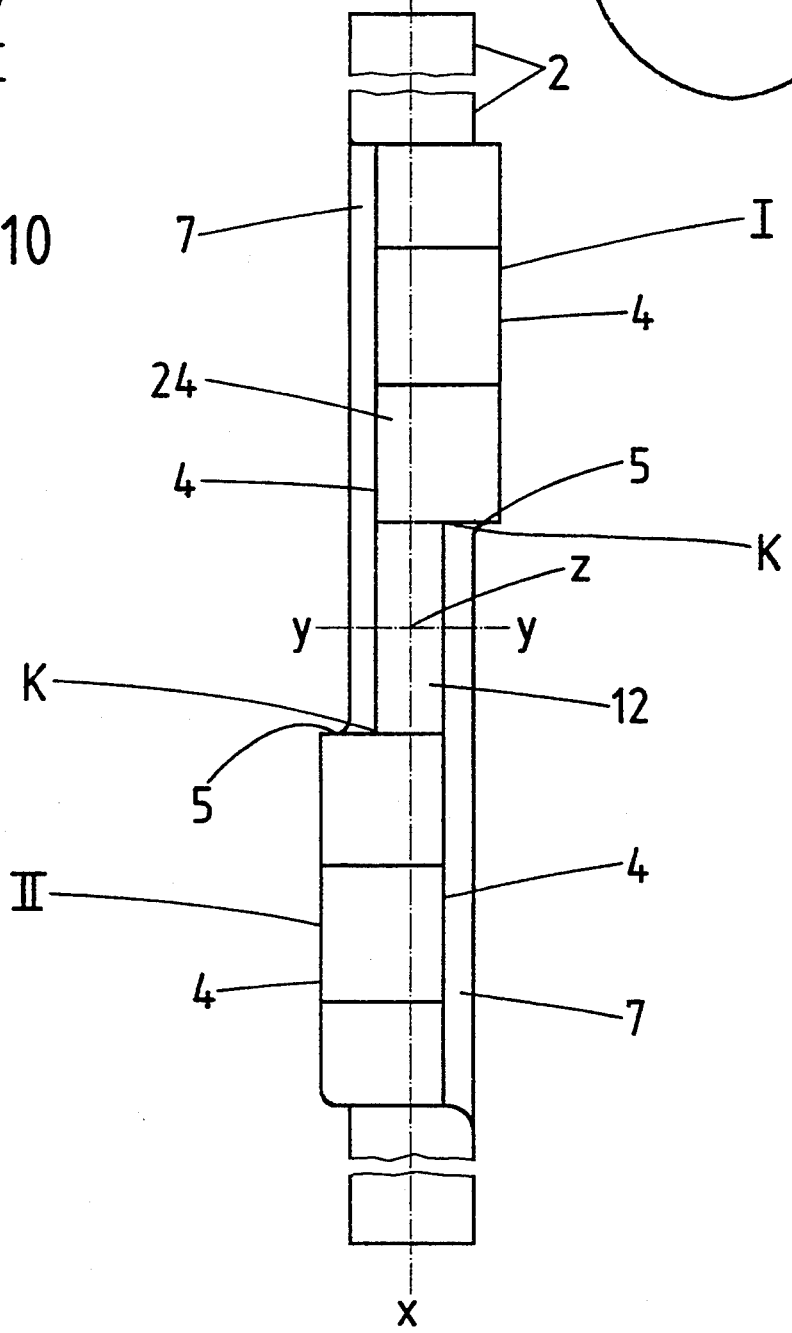
FIG. 10 is an end view looking at the end furthest from the handle, further enlarged.
Figure 11:
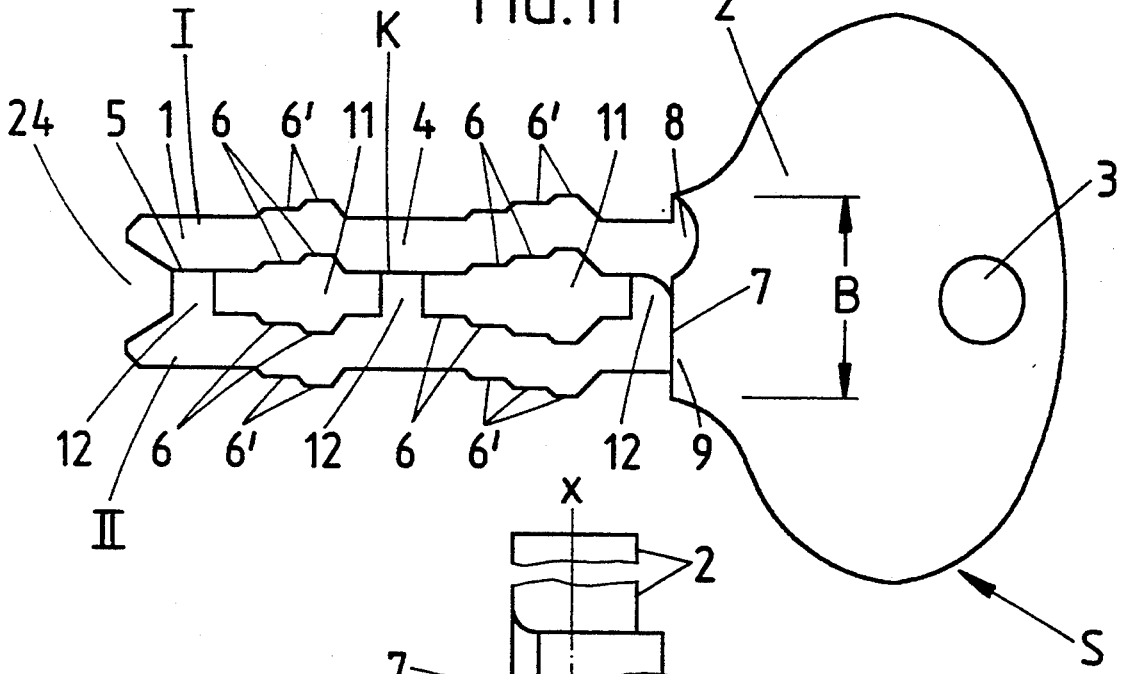
FIG. 11 shows the key in accordance with the third embodiment, in side view, enlarged.
Figure 12:
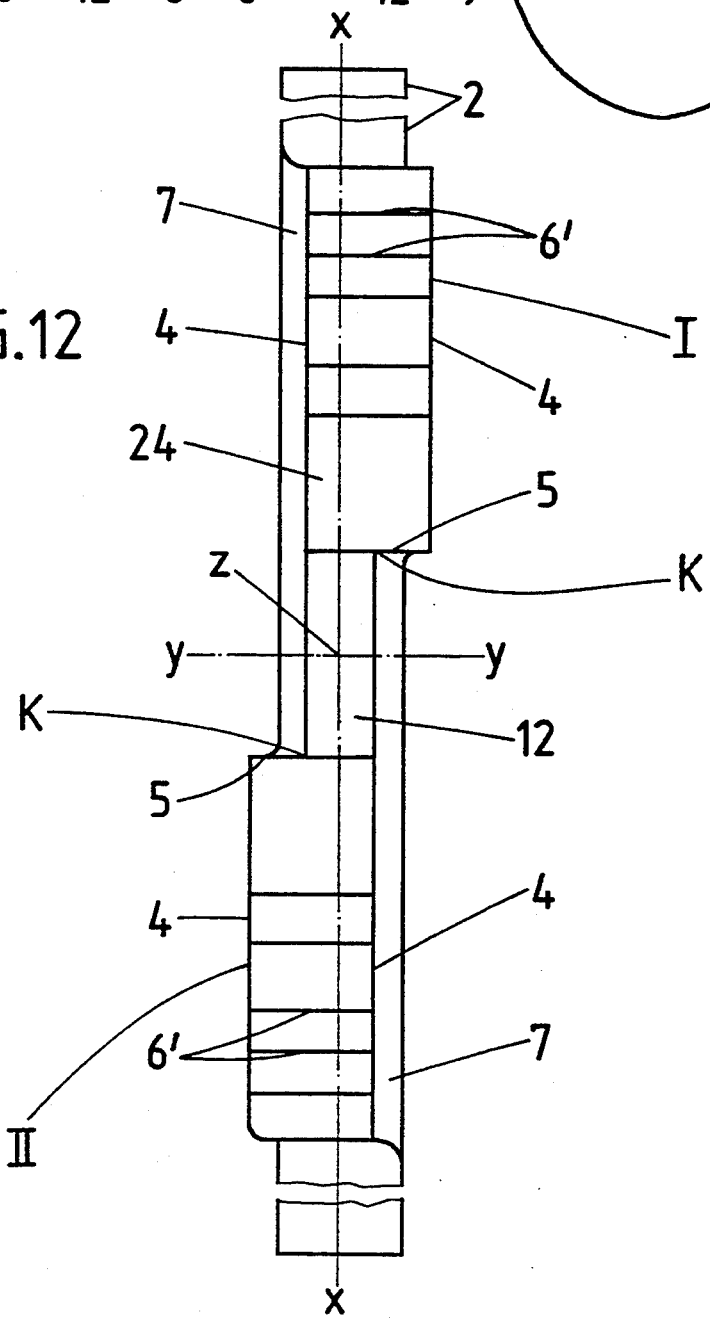
FIG. 12 is the corresponding end view seen from the end remote from the handle, enlarged.

If, in this connection, there is not involved an immediately fork-shaped structure, as shown in FIGS. 9 and 10 as a second embodiment, one can speak of a window-shaped wide-side opening 11.

The first embodiment (FIGS. 1-6) has a plurality of window-shaped wide-side openings 11 arranged one behind the other.

Functionally, however, one can speak also here of a fork-shaped basic structure, since the fork tines I and II formed by larger accumulations of material are connected merely via narrow arms 12. The latter are of substantially less thickness than the fork tines. In the drawing, there is a ratio of arm 12 to fork tine I or II of about 1:2.

Figure 5:
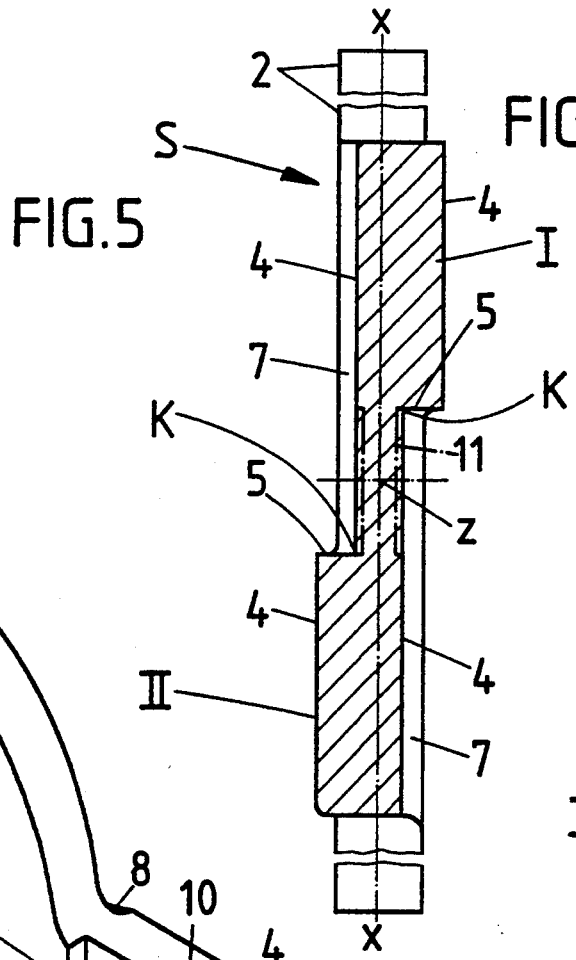
FIG. 5 is a section along the line V—V of FIG. 4.
Figure 6:
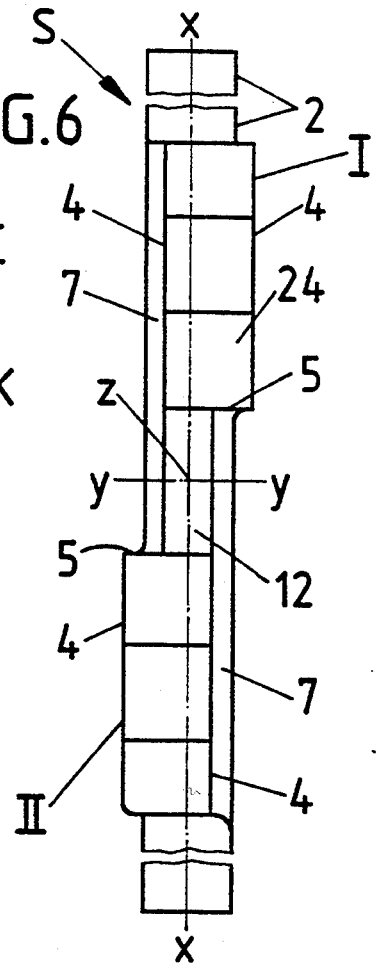
FIG. 6 is an end view of this key, i.e. looking at the end remote from the handle.

This measurement can, as shown in FIG. 5 in dot-dash line, be even far below this, once again for the purpose, even in the region of the arms 12 of the offset edge K, to recede in space still behind the wide-surface section of the wide-surface 4 which lies closer to the wide-side central plane x—x, so that no rounded inner fillet is functionally present even here.

Figure 7:
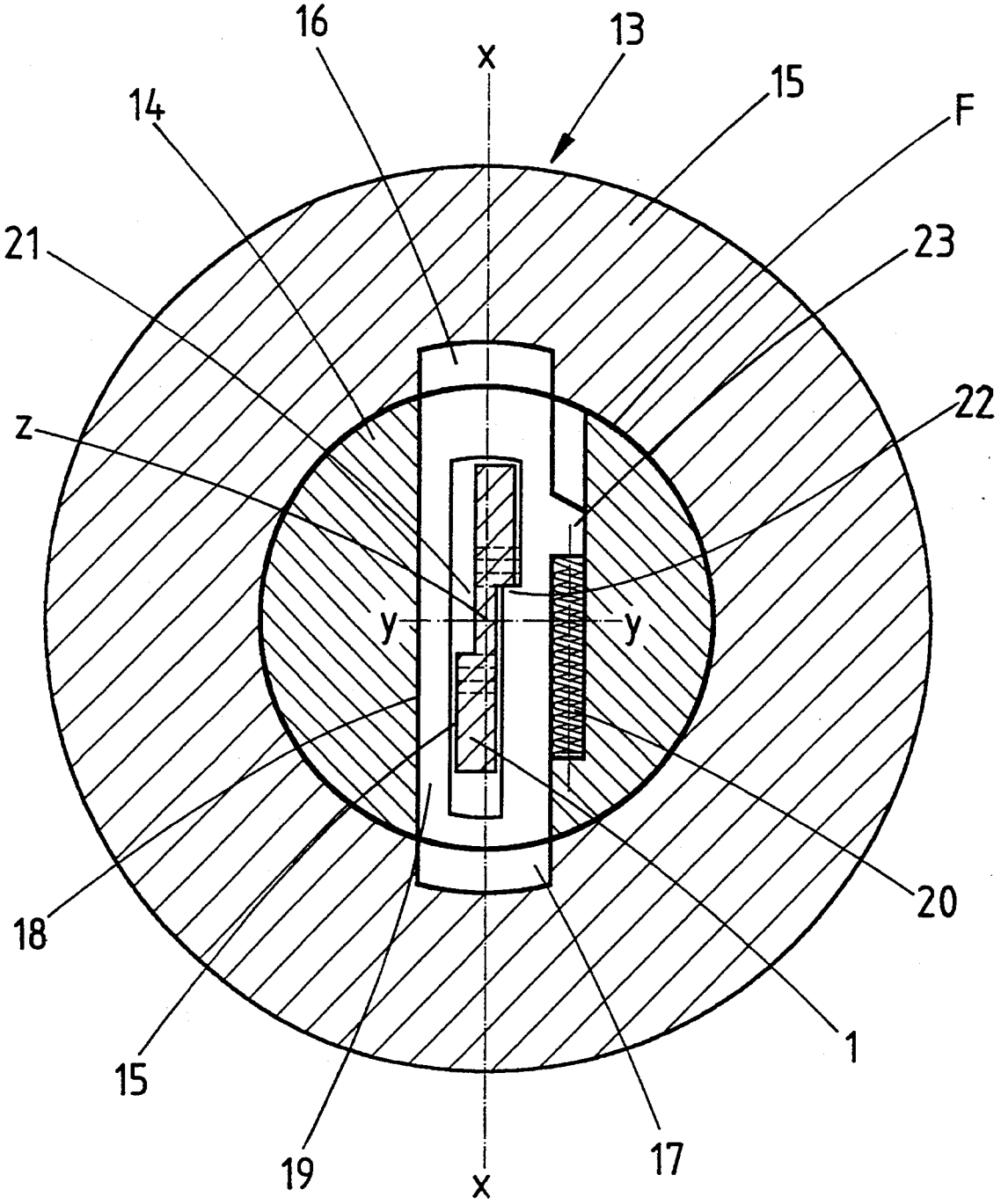
FIG. 7 is a cross section through a corresponding lock cylinder with key inserted.
Figure 8:
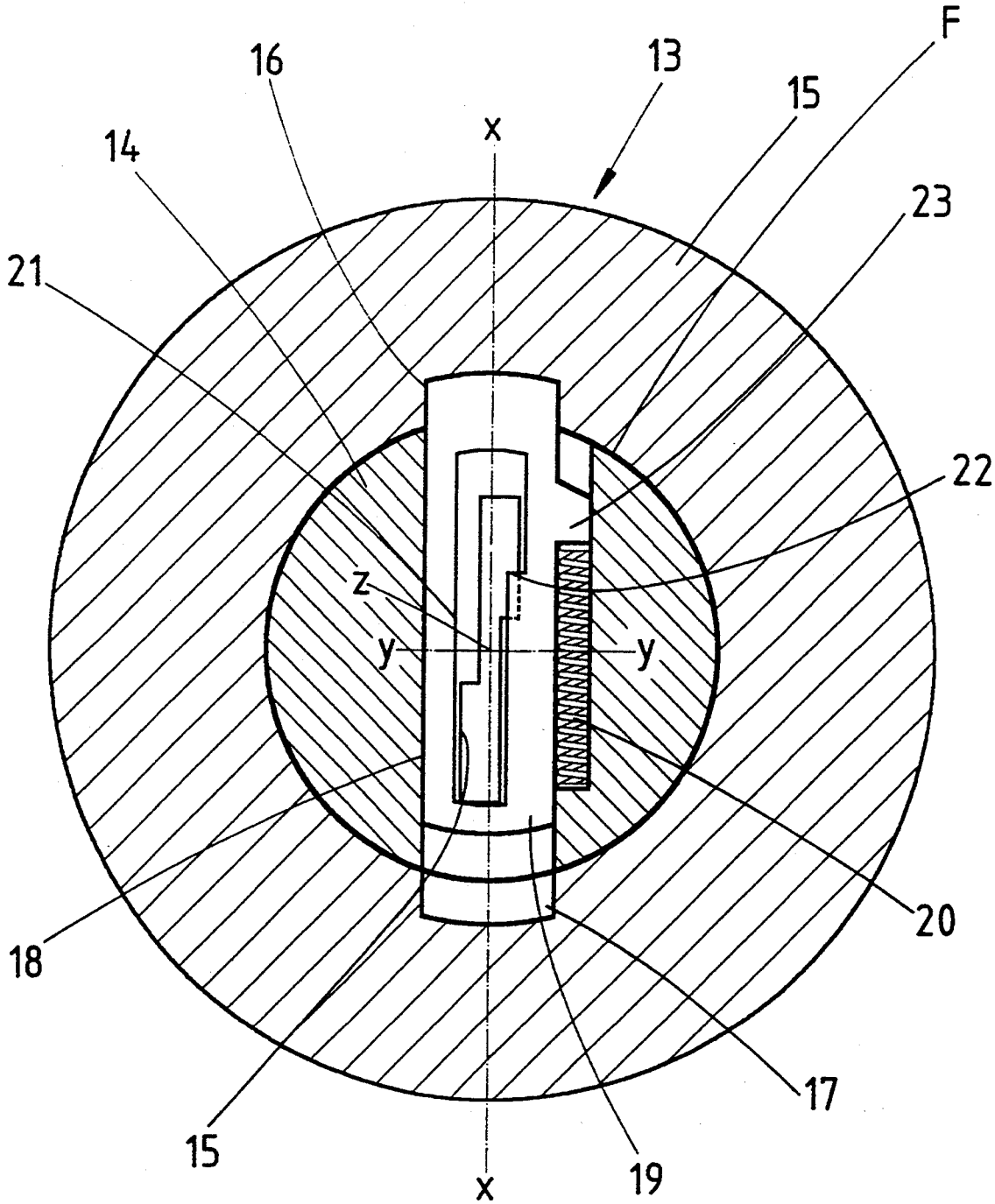
FIG. 8 is a similar section with key withdrawn.

FIGS. 7 and 8 show the corresponding lock-cylinder of the key S in cross section. The cylinder core 14 has a key channel 15 for the key shank 1 which has a suitable cavity profile. The cylinder core 14 is seated in a cylinder housing 15 which has blocking grooves 16, 17 diametrically opposite each other in the plane of the key channel.

In the region of the bit steps 6 of different depth, transverse channels 18 are arranged in a row within the cylinder core 14. Each of these channels receives a plate tumbler 19. They are acted on by a tumbler pressure spring 20. It strives to displace the plate tumbler 19 into the blocking position extending over the turning joint F in the manner that the end of the plate tumbler 19 facing the blocking groove 16 enters into the groove 16.

Furthermore, the tumbler spring 20 causes the contacting of the bit steps 6 and the corresponding positioning of the plate tumbler 19.

The plate tumbler 19 is broken through with due consideration of its need for movement and the silhouette of the key shank 1. The corresponding cut-out is provided with the reference numeral 21 and takes into account a feeling nose 22 which grips over the bit steps 6. To the side of this feeling nose 22 there is an outwardly directed finger 23 against which the tumbler spring 22 acts.

The function and further development of such lock parts are already known and do not require any further explanation.

The third embodiment of the key S differs from those described above in the manner that, in this case, the outer narrow edge of the fork tines I and II are also provided with bit steps. They bear the reference numeral 6' and appear as merely outwardly offset positive profile of the inner profile produced in the wide-side openings 11, i.e. on the inner narrow edges. The width of the fork tines continues analogously also with reference to the oblique flanks lying between the individual bit steps 6, said oblique flanks having an angle which lies outside the self-blocking function. It is about 45°.

The fork opening of all keys S is tapered on the end. The taper bears the reference numeral 24. The outer edges, on the other hand, are beveled. Both bevelings lie in the vicinity of about 45°.

As can be noted from the first and second embodiments, the arms 12 are distributed balanced in space, just behind the taper 24, at midlength of the key shank 1 and in front of the root region 9 of the handle.

The protrusion of the fork tines I and II beyond the wide side of the key handle 1 amounts to, for instance, about one-fourth of the thickness of the blank. Another fourth of this thickness is pushed-in up to the offset edge K so that a good half of the thickness of the blank is available basically for the width of the longitudinal shoulders 5. The reaming which extends to the wide-side opening covers at most the entire balance of this thickness.

One particularly advantageous method of manufacture is use of the laser process, in which case bit step 6 and the wide-side opening 11 are cut in one operation by the laser beam. In this connection, several blanks can be placed one above the other. In such case, it is more advantageous to produce the offset of the fork tines I, II obtainable by stamping only subsequently.

I claim:

1. In a lock-cylinder key having a key shank with bit steps protruding on wide sides of its key shank for positioning of lock-cylinder tumblers, the improvement wherein the bit steps lie on edges of an opening which opening extends through thickness of the key, said bit steps being on both sides of the opening.

2. A lock-cylinder key, according to claim 1, wherein the key shank is of fork-shaped development and there are two sections of fork tines lying on both sides of the opening, said two sections are arranged on opposite sides of the center plane of the wide side.

3. A lock-cylinder key, according to claim 1, wherein an offset is obtained by stamping.

4. A lock-cylinder key, according to claim 1, wherein said opening forms a window.

5. In a lock-cylinder key having a key shank with bit steps protruding on wide sides of its key shank for positioning of lock-cylinder tumblers, the improvement wherein a plurality of openings are arranged one behind the other and the bit steps lie on edges of the openings which openings extend through a thickness of the key.

6. In a lock-cylinder key having a key shank with bit steps protruding on wide sides of its key shank for positioning of lock-cylinder tumblers, the improvement wherein the bit steps lie on edges of an opening which opening extends through a thickness of the key, the key shank is of fork-shaped development and there are two sections of fork tines lying on both sides of the opening, said two sections are arranged on opposite sides of the center plane of the wide side, and arms, wherein the opening is formed by said arms which connect the fork tines and are of smaller thickness than said fork tines.

7. In a lock-cylinder key having a key shank with bit steps protruding on wide sides of its key shank for positioning of lock-cylinder tumblers, the improvement wherein the bit steps lie on edges of an opening which opening extends through a thickness of the key, the key shank is of fork-shaped development and there are two sections of fork tines lying on both sides of the opening, said two sections are arranged on opposite sides of the center plane of the wide side, and an outer narrow edge of the fork tines is also provided with bit steps.

8. A method of making a lock-cylinder key, the key having a key shank, according to claim 1, comprising the steps of cutting an opening extending through a thickness of the key having bit steps on edges at both sides of the opening protruding on wide sides of the key shank, the bit steps and the opening being cut in one operation by a jet.

9. The method, according to claim 8, wherein said cutting by said jet is performed by a fluid jet.

10. The method, according to claim 8, wherein said cutting by said jet is performed by a laser beam.

* * * * *